US006659059B1

(12) United States Patent
Huff

(10) Patent No.: US 6,659,059 B1
(45) Date of Patent: Dec. 9, 2003

(54) VARIABLE DISPLACEMENT VALVE SEAT FOR INTERNAL COMBUSTION ENGINES

(75) Inventor: Reggie Dwayne Huff, St. Helens, OR (US)

(73) Assignee: EnginTec, Corp, Warren, OH (US)

( * ) Notice: Subject to any disclaimer, the term of this patent is extended or adjusted under 35 U.S.C. 154(b) by 0 days.

(21) Appl. No.: 09/717,597

(22) Filed: Nov. 21, 2000

Related U.S. Application Data

(60) Provisional application No. 60/167,579, filed on Nov. 26, 1999.

(51) Int. Cl.[7] ..... F02N 3/00
(52) U.S. Cl. ..... 123/188.3; 123/79 C
(58) Field of Search ..... 123/81 R, 81 B, 123/188.2, 188.3, 188.8, 79 C

(56) References Cited

U.S. PATENT DOCUMENTS

| | | | | |
|---|---|---|---|---|
| 2,191,745 | A | 2/1940 | Barkeij | 123/79 C |
| 2,698,615 | A | 1/1955 | Dittmann | 123/188.7 |
| 3,507,261 | A | 4/1970 | Myers | 123/188.14 |
| 3,762,381 | A | 10/1973 | Dave | 123/90.15 |
| 3,903,855 | A | 9/1975 | Klakulak et al. | 123/90.14 |
| 4,094,277 | A | 6/1978 | Goto et al. | 123/79 C |
| 5,730,092 | A | 3/1998 | Kim | 123/90.15 |

*Primary Examiner*—Noah P. Kamen

(57) ABSTRACT

A variable displacement valve seat that consists of an annular ring which is affixed concentrically around a standard valve seat. The annular ring is affixed loosely to allow linear coaxial movement along the valve seat center-axis line. The movement is restricted to a small fraction of the valves actual displacement, approximately 12% or less, in the preferred embodiment. The annular ring is affixed to the valve seat insert installed in the cylinder head when used on the exhaust side. The annular ring is affixed to the head portion of the poppet valve itself when used on the intake side. The concept can provide an effective range of early closing times for the valves to control reversion. In addition, the actuation of the moveable seat is variable and automatic, and controlled by cycle exchange functions.

7 Claims, 9 Drawing Sheets

VARIABLE DISPLACEMENT VALVE SEAT FOR INTERNAL COMBUSTION ENGINES

This application claims benefit under 35 USC 119 (e) Priority Filing of U.S. Provisional Patent Application #60/167,579, filed Nov. 26, 1999.

BACKGROUND

The invention here disclosed relates primarily to a reciprocating intake valve for controlling the movement of air/fuel mixture into the combustion chamber (cylinder) of internal combustion engines, and; the exhaust port valve seat insert for providing an effective seat surface for the exhaust valve to effectively seal the exhaust port of internal combustion engines.

In typical internal combustion engines the intake valves and the exhaust port seats are of a single piece construction and are incapable of varying the displacement of each respective valve seat, relative to its mating counterpart, independent of typical valve control mechanisms.

Since the efficiency and timing of this valve arrangement is a major factor in the performance of the entire engine, there have been many attempts at improving the mechanical motion of valves to maximize the flow dimension (volume) of this valve and port arrangement. Further, since the timing of these valve arrangements is an important factor in the performance of internal combustion engines, many attempts to vary the timing of the displacement of intake and exhaust valves in relation to their respective ports in relation to engine speed, engine load, and atmospheric conditions have been explored.

Increasing the flow dimension allowed by the valve and port arrangement increases the power (output) of the engine. Varying the timing of valve to port opening and closing events in relation to engine speed, engine load, and atmospheric conditions also increases the power as well as the fuel efficiency, and reduces the environmentally harmful emissions of internal combustion engines. In addition, the idle performance, low speed operational control, and cold starting performance, etc., can all be dramatically enhanced relative to increased peek output.

It is toward these fundamental factors of improved flow dimension (volume) and constant variable valve to port timing that the here disclosed invention takes a giant step forward by accomplishing both at the same time, while minimizing current engine design intrusiveness.

It is further the intent of the here disclosed invention(s) to address various deficiencies, compromises, and other important factors reveled through the study of early design attempts to accomplish similar advantages. The most intriguing and promising being that disclosed in U.S. Pat. No. #3,903,855 to Klakulak et al, and assigned to General Motors Corporation, and U.S. Pat. No. #4,094,277 to Goto et al, and assigned to Toyota Corporation. These early designs integrate an "auxiliary" inlet valve structure, which is operated and controlled by pressure differentials during the inlet cycle. The auxiliary inlet valve is designed to effectively allow flow in one direction. While these inventions would allow for improved effective valve timing at low engine speeds their structure would also reduce the flow dimension of the inlet conduit primarily at mid to high engine speeds.

In addition, these designs require the mass and the displacement range of the auxiliary valve to be excessive, creating excessive inertia potential during normal operating conditions. This inertia potential requires excessive spring biases to be applied to the auxiliary valve, which severely limits the flow potential of the inlet conduit and/or effective back-flow restriction and response timing.

It is further recognized by the present invention that the early designs are excessively complex. This further complicates manufacture and implementation of the invention as well as increases costs unnecessarily.

It is the object of the here disclosed invention to significantly enhance the commercial acceptability of a previously recognized important concept by demonstrating vast improvements in all fundamental areas of concern, including performance, longevity, manufacturability, implementation, and cost at the same time.

It is further the object of this invention to allow reduced overall valve and related valve train component stress compared to current levels, and allow for the potential extension of the concept to the exhaust process.

Further clarification of the advantages and features of the present invention(s) is provided within the specification.

BRIEF SUMMARY OF INVENTION

This invention relates primarily to engine valve seating, and, in particular, the reciprocating valves necessary for either the intake of air/fuel mixture into, or the expelling of exhaust gases out of, the combustion chambers of conventional internal combustion engines.

In order to obtain the maximum power output and efficiency of conventional internal combustion engines it is necessary to maximize the flow dimension of the air/fuel mixture and exhaust gases to and from the combustion chamber at all speed and load conditions. The traditionally accepted method used to attempt this is by use of single stage (function) reciprocating intake and exhaust valves actuated by a cam transferring a predetermined displacement sequence motion to a rocker arm that transfers its motion to the tip of the valve stem, controlling the valve's displacement and timing.

Due to the mechanical limitations of this traditional method, lengthy initial opening and final closing events are necessary to dampen the valve's opening and closing action. This condition has a particularly negative effect on the low to mid-speed performance, fuel economy, and emissions of typical internal combustion engines. These mechanical limitations also limit the phase timing, lift, duration, rate of lift, and all timing dimensions relative to associated (co-joined) cylinders to one single static timing for all valves relative to all cylinders at all times and in all conditions relative to crankshaft angle. This forces the engine designer to accept compromises that have a negative effect on engine performance, fuel economy, and emissions, at virtually all speed and load settings.

The invention disclosed herein is an intake or exhaust valve seat for internal combustion engines that automatically, independently, and extremely rapidly varies its displacement or position relative to the intake or exhaust valve, to either enhance or constrain the flow of atmosphere to or from the combustion chamber in direct response to engine speed, load, and ambient atmospheric conditions.

In the preferred embodiments the intake valve is designed with an auxiliary annular ring which acts as a valve seat and is designed to be linked concentrically around the outer circumference of the intake valve head. The annular ring seat and valve arrangements are designed to allow the ring seat to alter its displacement relative to the valve head coaxially in the direction of the valve stem for a predetermined displacement range while not allowing disengagement of the ring seat from the valve head.

The same concept is simply inverted in the case of the exhaust process and the annular ring seat is applied in a similar manner to the exhaust seat insert which is affixed to the exhaust port in the combustion chamber and acts as a seat for mating with the exhaust valve seat.

In all cases the ring seats actuation and displacement is dependent of pressure differentials created between the cylinder and the respective intake and exhaust ports during the normal operation of an internal combustion engine.

The independent control of the ring seat(s) and displacement allows the engine to time its actuation with flow demand and its timing, which varies throughout a wide spectrum of speed versus load conditions. This allows for increases in overall performance and efficiency of internal combustion engines over a broad range of conditions and applications.

DETAILED DESCRIPTION OF PREFERRED EMBODIMENTS

Figure 1:
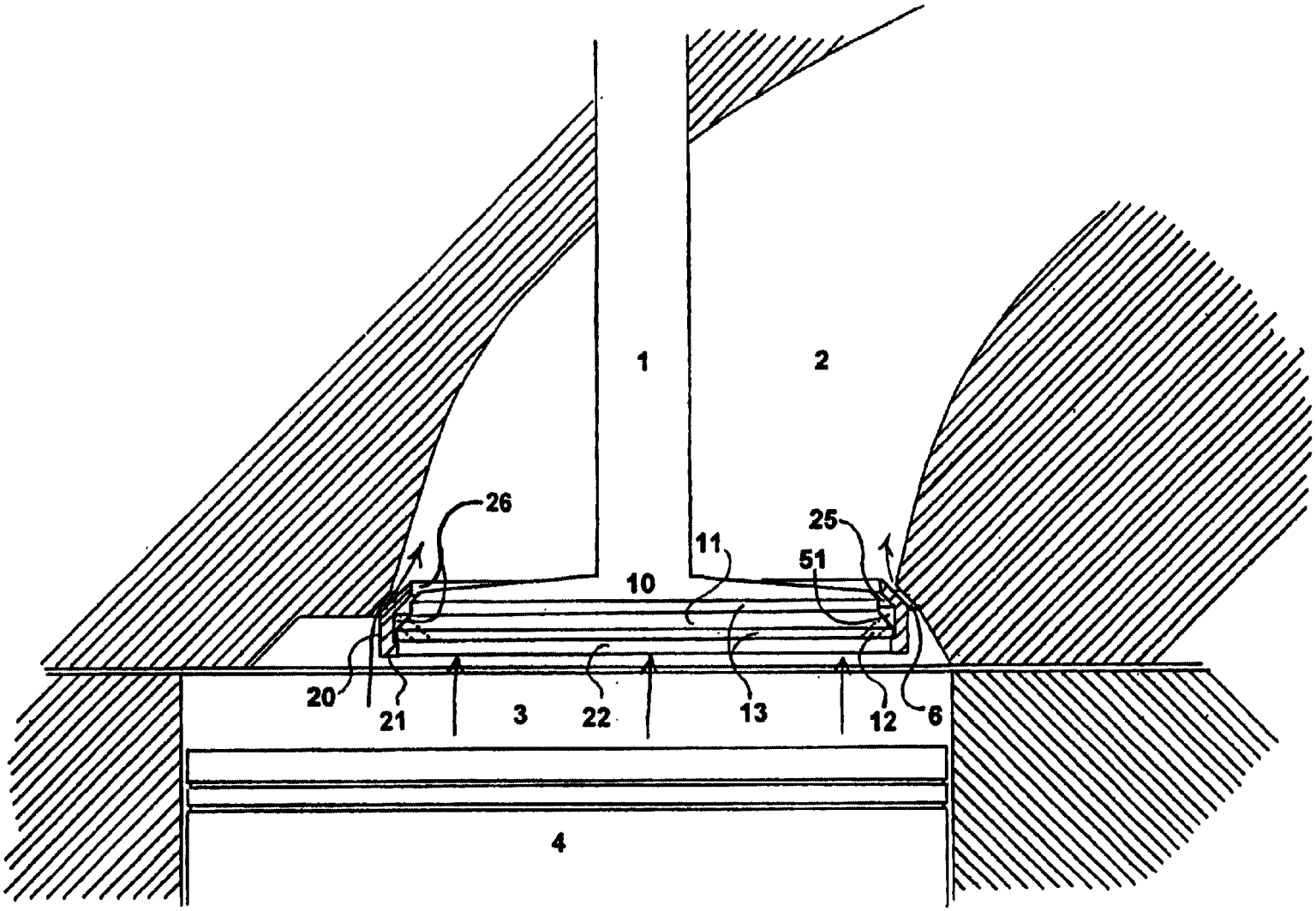
FIG. 1 is a sectional front view of a typical internal combustion engine comprising an intake valve which includes the auxiliary annular seat structure.
Figure 3:
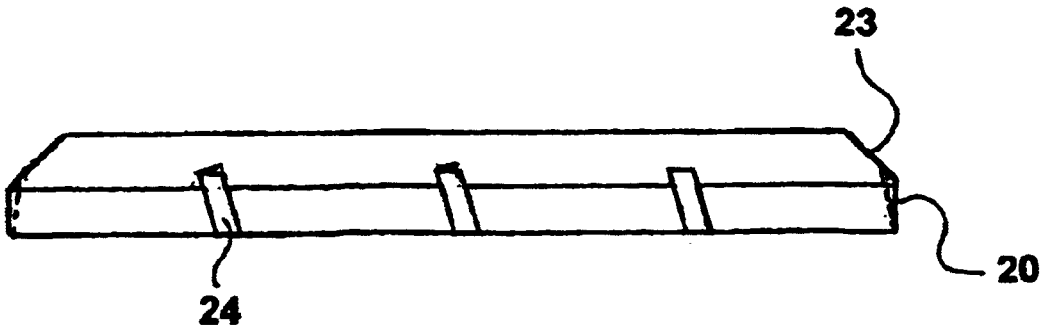
FIG. 3 is a front view of the auxiliary annular seat structure.
Figure 4:
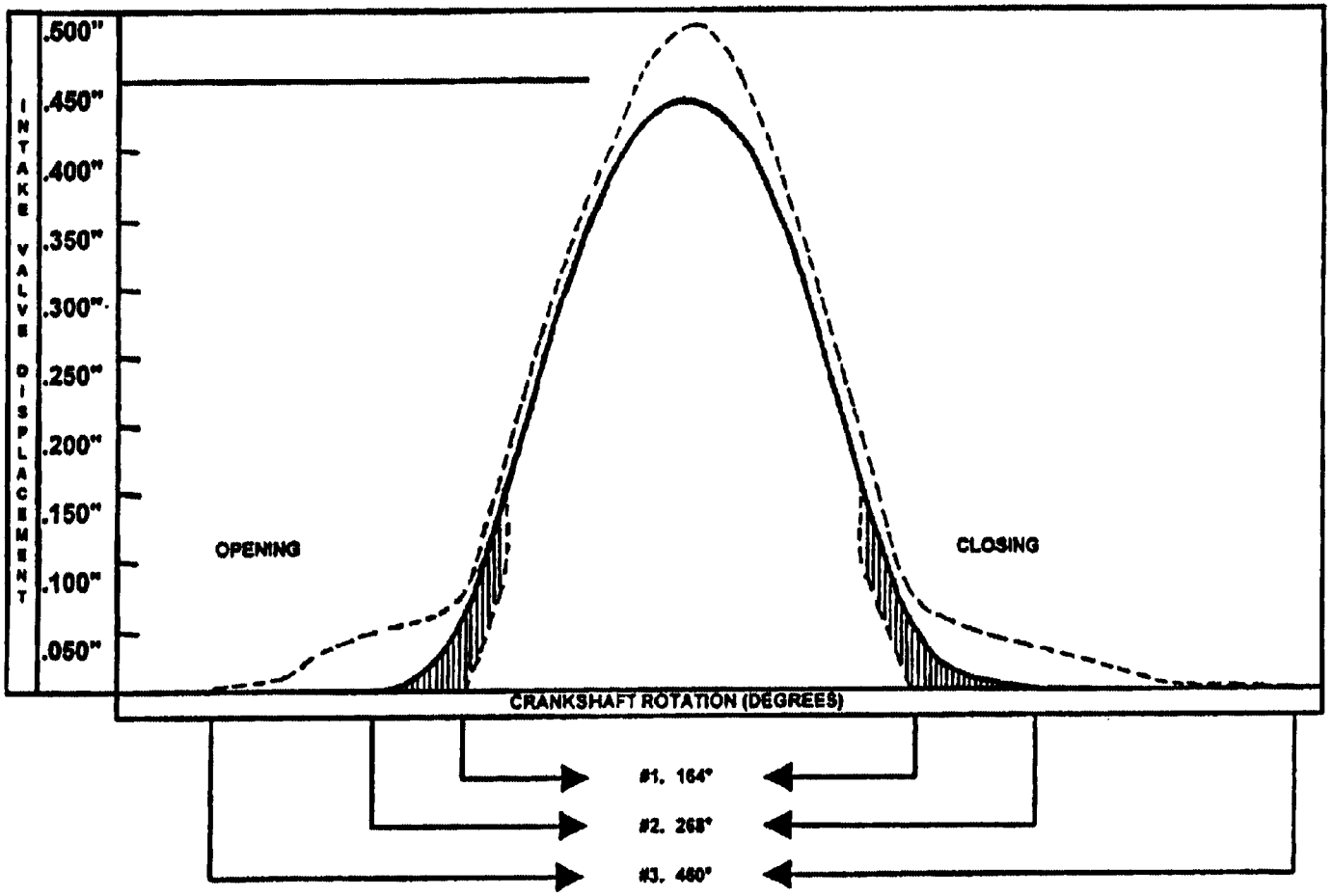
FIG. 4 is a graphical illustration of a typical valve displacement sequence with a comparison to several of many potential effective valve displacement sequences allowed by the here disclosed invention.
Figure 5:
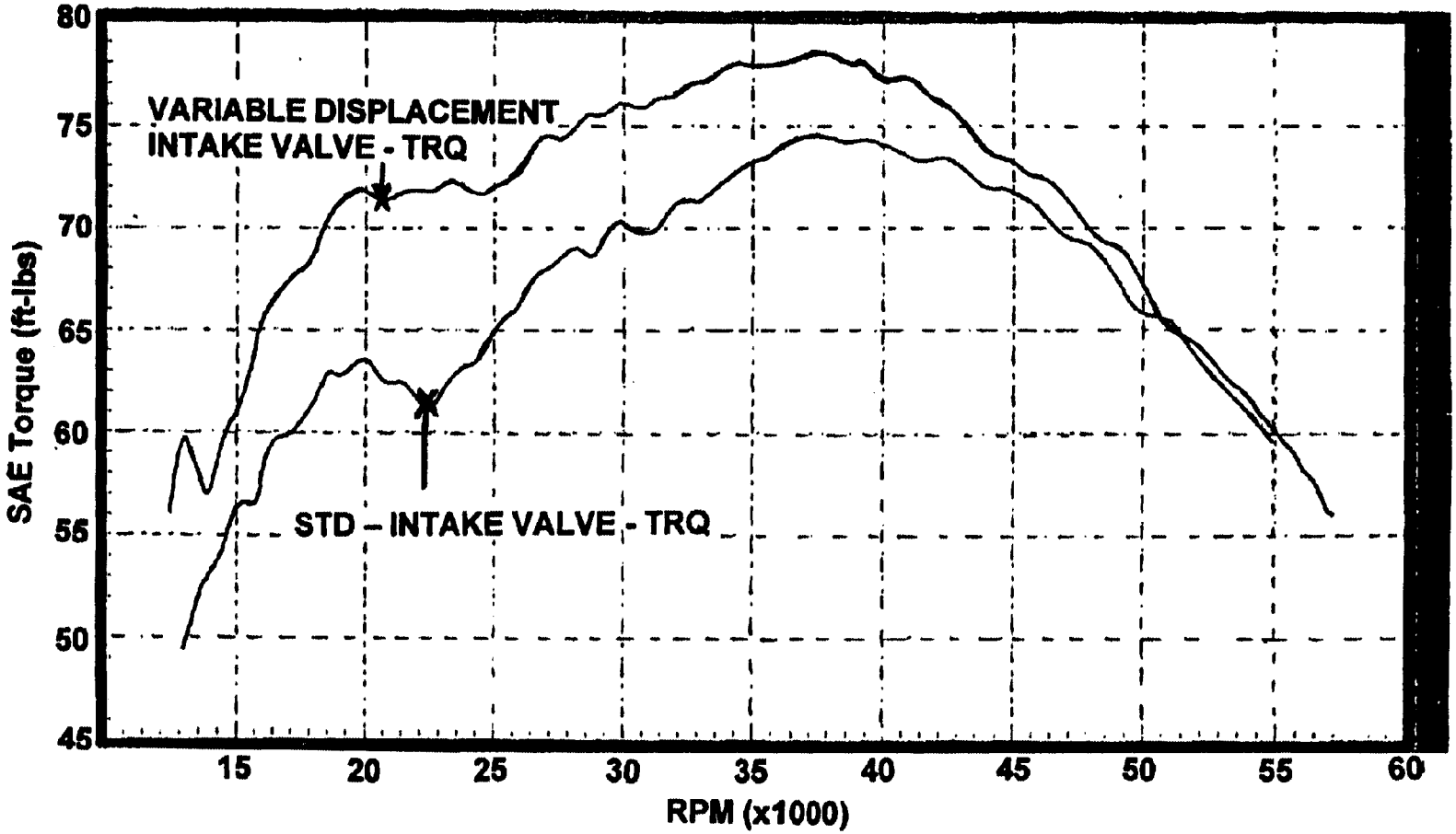
FIG. 5 is a graph showing test results of how performance is enhanced at all speeds compared to standard valve timing when using an intake valve structure constructed in accordance with the invention wherein an auxiliary annular valve seat is employed in cooperation with a conventional intake poppet valve.
Figure 6:
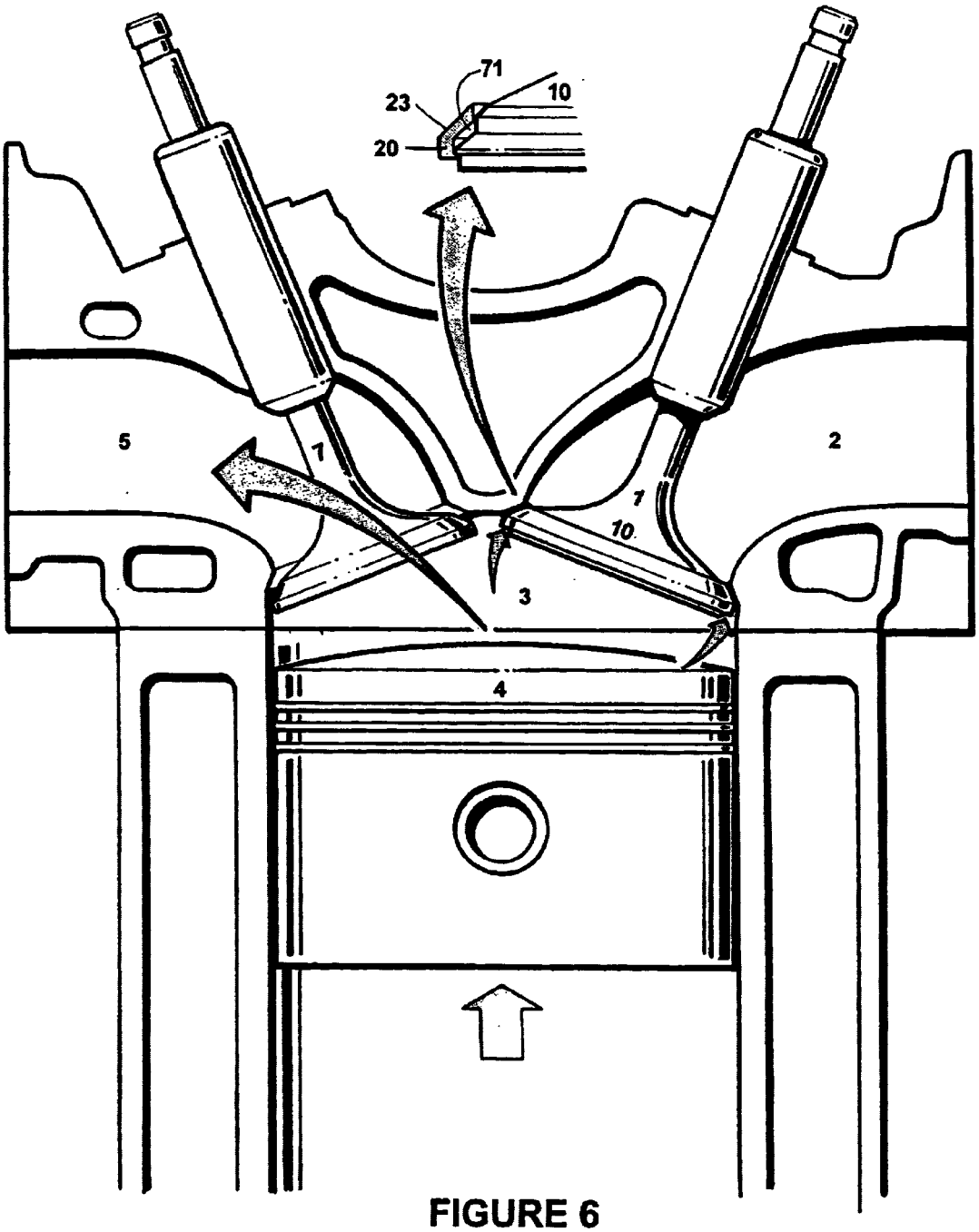
FIGS. 6, 7, 8, & 9 are sectional front views of a typical internal combustion engine comprising an intake valve which includes the auxiliary annular seat structure and designed to depict the operation and function of the auxiliary seat in series in concert with typical engine function.
Figure 7:
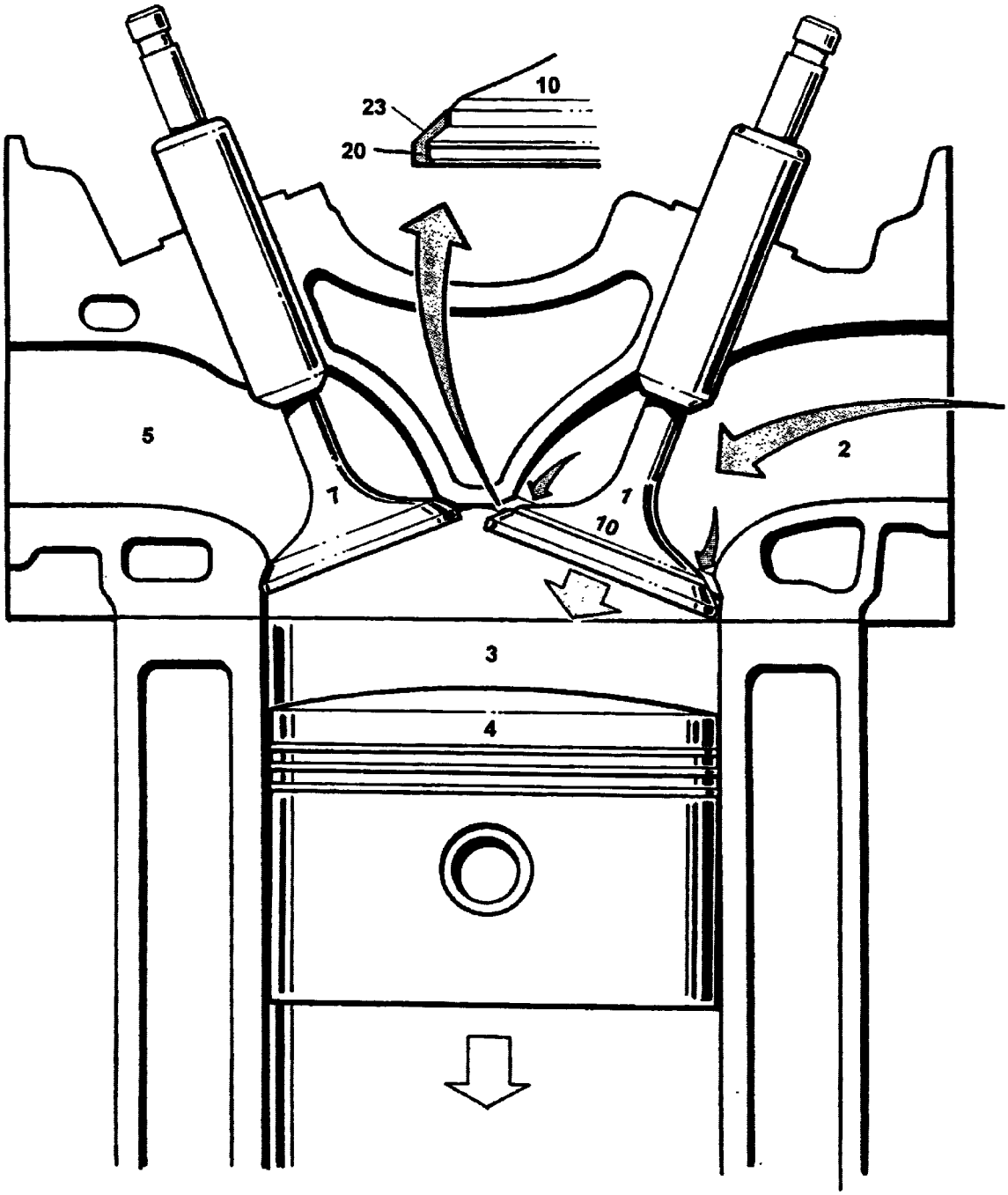
Figure 8:
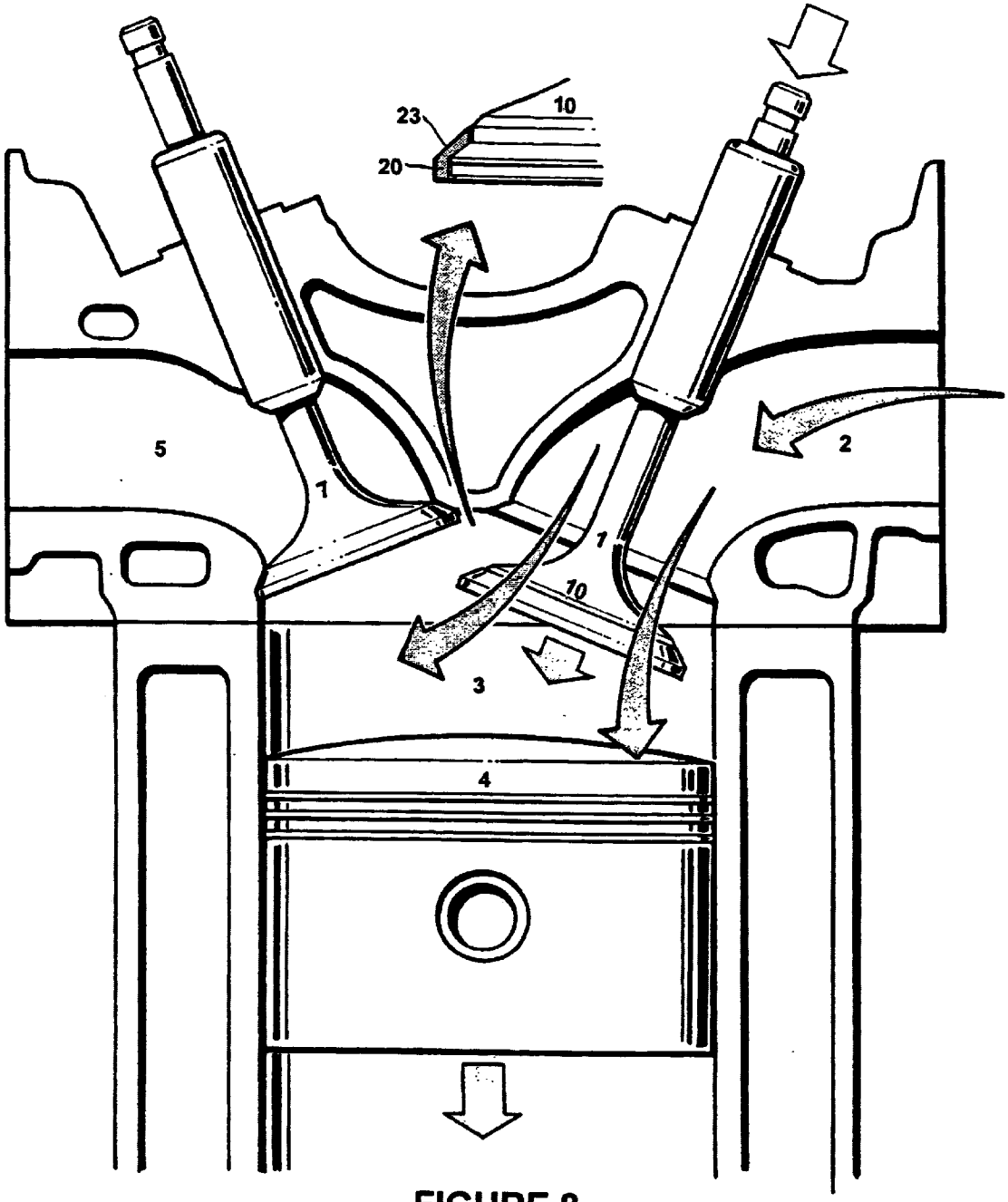
Figure 9:
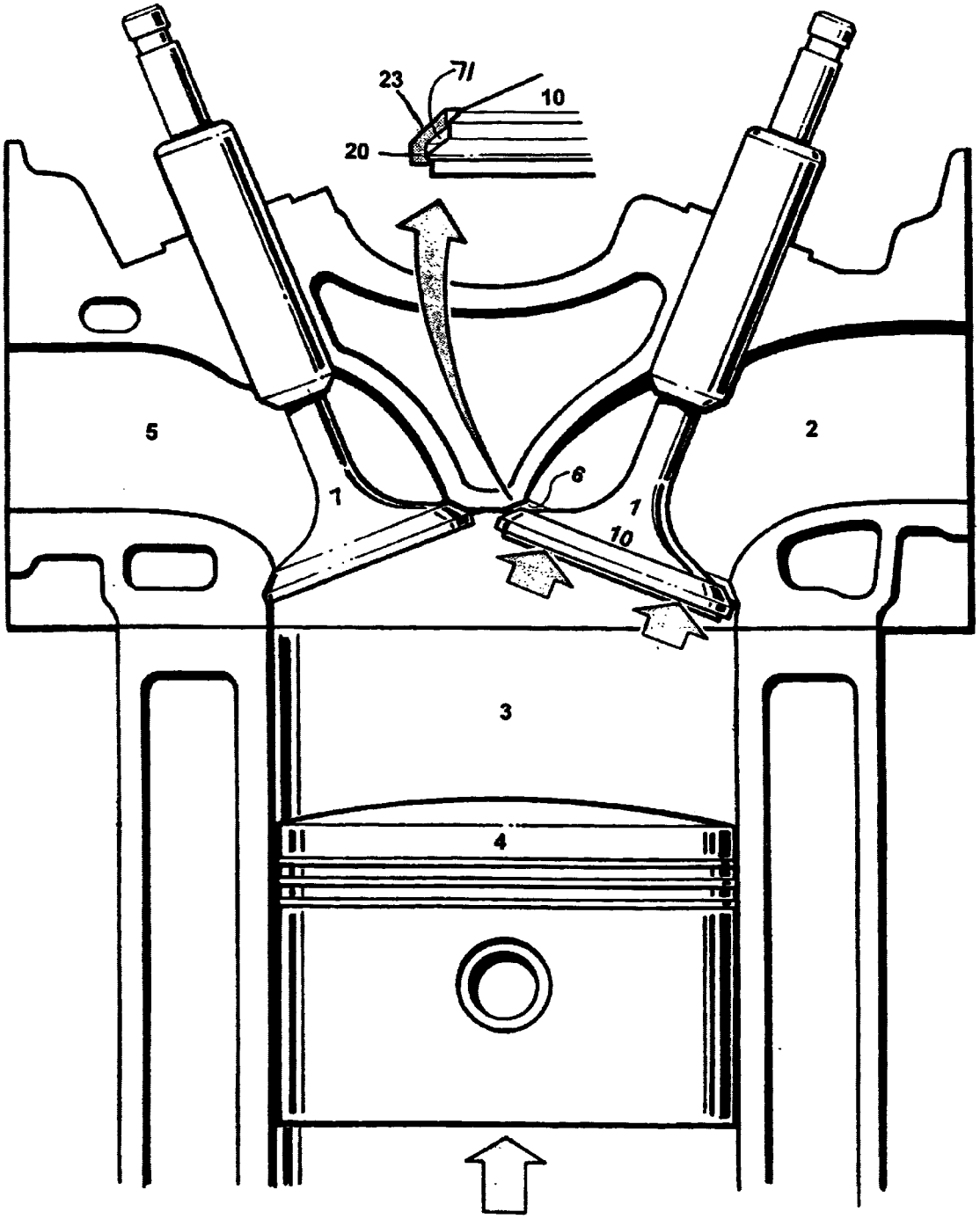

As illustrated by FIGS. 1 & 3, the intake valve, FIG. 1-#1, is arranged within a typical internal combustion engine to releasably seal an intake port, FIG. 1-#2. The intake valve includes a valve head, FIG. 1-#10, which is specially formed to accept an auxiliary annular ring seat, #20, around the outer periphery of the intake valve head, FIG. 1-#10.

The inside diameter of the annular ring seat, #20, includes a reduced step, FIG. 1-#22, which is sized slightly under the outer most diameter of the intake valve head, FIG. 1-#13.

The reduced step, FIG. 1-#22, allows the annular ring seat as a unit to be pressed onto and past the outer most diameter of the intake valve head, FIG. 1-#13, to effectively lock the annular ring seat into engagement with the intake valve head, FIG. 1-#10.

The internal diameter surfaces of the annular ring seat above the reduced step, FIG. 1-#26, are sized to fit loosely over the outer intake valve head surfaces FIG. 1-#13, so as to allow controlled linear coaxial displacement of the annular ring seat in the direction of the intake valve stem, FIG. 1-#10, to a predetermined limit.

The intake valve head includes an outside angled seating surface, FIG. 1-#11, which corresponds with an inside angled seating surface within the annular ring seat, FIG. 1-#25. The annular ring seat includes an outside seating surface, FIG. 3-#23, which corresponds with an angled seating surface at the terminal end of the intake port, FIG. 1-#6.

The intake valve head includes gas pressure access holes, FIG. 1-#12, to effectively enhance the floating seat response to pressure differential between the intake port, FIG. 1-#2, and the cylinder and combustion chamber, FIG. 1-#3.

Figure 2:
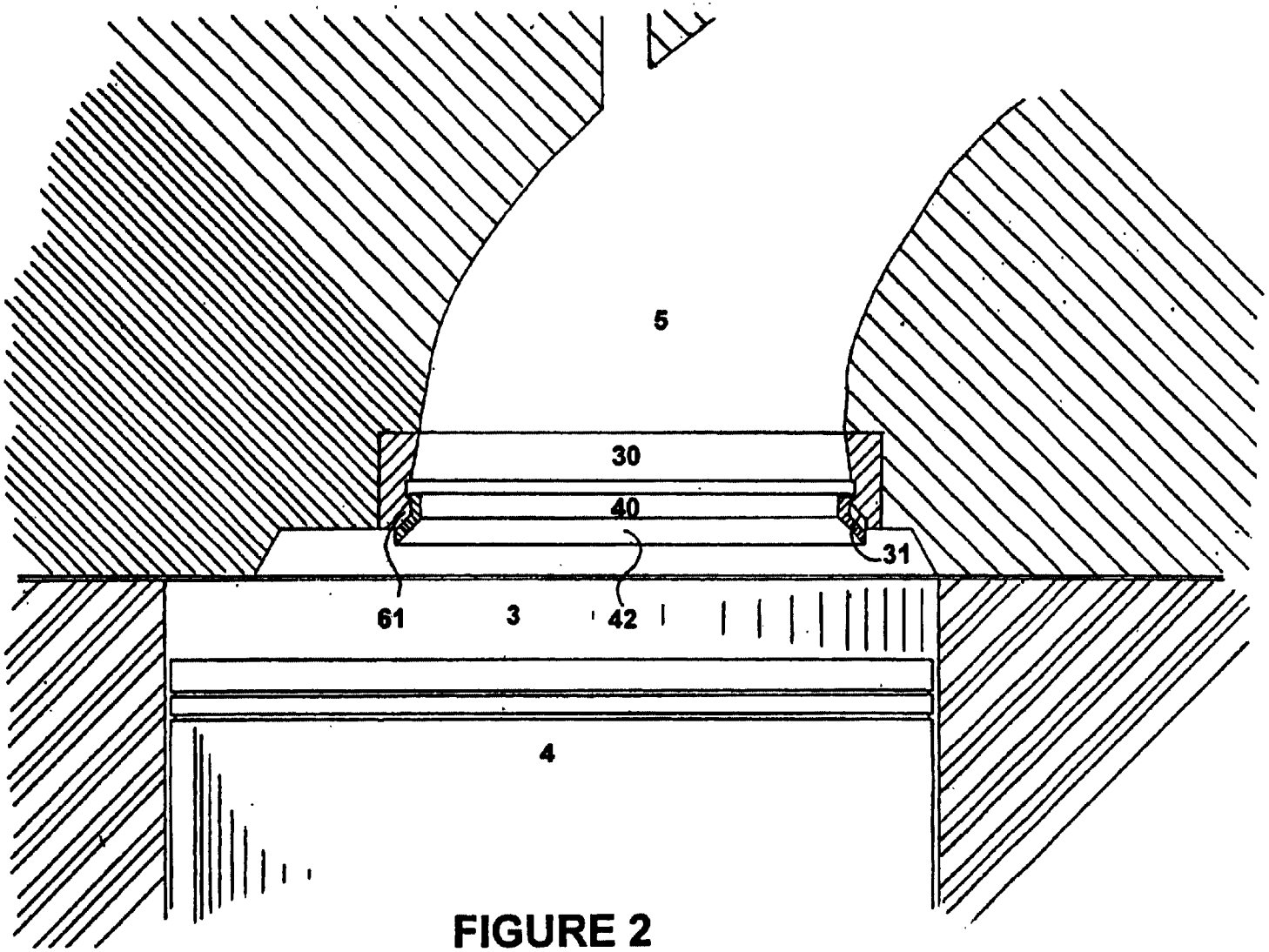
FIG. 2 is a sectional front view of a typical internal combustion engine comprising an exhaust conduit without an exhaust valve and an exhaust seat insert which includes the auxiliary annular seat structure.

As illustrated by FIG. 2, the exhaust port seat insert, #30, is arranged within a typical internal combustion engine to provide an effective seating surface for an exhaust valve (not shown).

The exhaust port seat insert, #30, is designed to accept an auxiliary annular ring seat, #40, which is designed in an inverted format to the previously described intake annular ring seat. The exhaust annular ring seat, #40, is designed to allow for locked engagement with the seat insert, and for an predetermined linear co-axial displacement in similar fashion to the previously described intake valve design.

DETAILED OPERATIONAL OF THE PREFERRED EMBODIMENT

FIG. #6: Exhaust cycle ending
- Piston, #4, nearing top dead center (TDC)
- Intake valve, #1, open approximately 0.050"
- Floating seat, #20, closed
- Inert exhaust back-flow stopped from flowing from the combustion chamber, #3 to the
- intake port, #2.
  - Mechanical stress to floating seat & valve: Virtually zero (0)
    - Floating seat, #20, has not moved FIGURE #7: Piston, #4, at or past TDC
- Intake valve, #1, open 0.050"+
- Pressure in combustion chamber, #3, drops below intake charge pressure in the intake port, #2, signaling beginning of induction cycle.
- Floating seat, #20, reacts and drops to lower seat position as quickly as needed, creating the effect of near instant valve opening.
  - Mechanical stress to floating seat & valve: Miniscule
    - Floating seat weighs 7 grams and has no time to build up significant inertia.
    - Force created by pressure differential relatively extremely low
    - Mating surface very accurate and relatively many times greater than normal valve to seat mating surface.
  - Generates no audible sound FIG. #8: Piston, #4, at ½ stroke past TDC
- Intake valve, #1, open, nearing maximum lift
- Pressure differential and inertia effects lock floating seat in fully mated position throughout induction cycle, simulating standard valve head profile
  - Mechanical stress to floating seat & valve: Zero (0)

FIG. #9: Piston, #4, past bottom dead center (BDC)
- Intake valve, #1, closing, still open 0.050"+
- Pressure in cylinder, #3, increases above intake charge pressure in intake port, #2.

Floating seat, #20, reacts as fast as needed to create effect of near instant intake valve closure Fresh charge back-flow stopped Mechanical stress to floating seat & valve:

Miniscule compared to normal valve seating forces

Floating seat weighs 7 grams and has no time to build up significant inertia.

Air trapped between floating seat and valve, #71, can actually cushion valve closure and reduce stress to entire valve train and valve, and reduce high speed bounce.

What is claimed is:

1. A variable displacement valve seat assembly effective for prevention of opposite directional flow of gases to or from the combustion chamber through the intake and exhaust ports of an internal combustion engine, said valve seat assembly comprising:

a) A base seat means designed to releasably seal an annular ring seat, said base seat means including a base seat mating surface, b) an annular ring seat means, including both an inboard and outboard seat mating surface, said inboard seat mating surface designed to correspond with said base seat mating surface, said outboard mating surface designed to releasably seal an intake or exhaust port within the combustion chamber of an internal combustion engine, c) a locked engagement means designed to lock the said annular ring seat means into releasably sealable engagement with said base seat means, said locked engagement means designed to allow controlled linear coaxial displacement of said annular ring seat means to a predetermined limit.

2. The variable displacement valve seat assembly in claim 1 including dissimilar angles between the inside and outside beveled seats.

3. The variable displacement valve seat assembly in claim 1 including flutes formed in the outer circumference of the said variable displacement valve seat.

4. The variable displacement valve seat assembly in claim 1 including gas pressure access holes through the said base seat means to effectively enhance the said variable displacement valve seat response to pressure differentials that define its actuation, movement, and timing.

5. The variable displacement valve seat assembly in claim 1 including a variable displacement seat constructed of a silicon carbide matrix material.

6. The variable displacement valve seat assembly in claim 1 including a variable displacement valve seat constructed of a titanium alloy material.

7. The variable displacement valve seat assembly in any one of claims 1–6 wherein said valve seat assembly is affixed to a vented poppet valve for internal combustion engines.

* * * * *